United States Patent [19]

Iio et al.

[11] Patent Number: 4,808,953

[45] Date of Patent: Feb. 28, 1989

[54] CIRCUIT BREAKER

[75] Inventors: Tsukasa Iio; Yoshinori Mochizuki; Yasusi Genba; Hiroshi Fujii; Hideaki Moriwaki, all of Fukuyama, Japan

[73] Assignee: Mitsubishi Denki Kabushiki Kaisha, Tokyo, Japan

[21] Appl. No.: 98,034

[22] Filed: Sep. 17, 1987

[30] Foreign Application Priority Data

Sep. 18, 1986 [JP] Japan ..... 61-222514
Sep. 18, 1986 [JP] Japan ..... 61-144504[U]
Sep. 18, 1986 [JP] Japan ..... 61-144506[U]

[51] Int. Cl.[4] ..... H01H 75/10; H01H 77/06
[52] U.S. Cl. ..... 335/42; 335/176
[58] Field of Search ..... 335/42, 45, 176, 8, 335/9, 10, 174; 337/48, 49

[56] References Cited

U.S. PATENT DOCUMENTS 3,775,713 11/1973 Walker et al. ..... 335/42
3,906,414 9/1975 Kidd et al. ..... 335/42

FOREIGN PATENT DOCUMENTS 52-138267 10/1977 Japan .

*Primary Examiner*—H. Broome
*Attorney, Agent, or Firm*—Lowe, Price, LeBlanc, Becker & Shur

[57] ABSTRACT

In a circuit breaker having electromagnetic tripping device (55), thermal tripping device (56,57), and adjusting device (59–64), the adjusting device (59–64) is disposed above the thermal tripping device (56,57) in perpendicular direction to power source side-load side direction, and the adjusting device (59–64) has an arm (69) for transmitting adjusting actions from an adjusting dial (24) to a movable iron core (55*a*) of the electromagnetic tripping device (55), and such constitution enables to shorten a configuration in the power source side-load side direction, and enables to compensate loose-assembly or deformations of the adjusting device (59–64), and thereby initial setting for the adjusting device (59–64) becomes correct.

4 Claims, 10 Drawing Sheets

CIRCUIT BREAKER

FIELD OF THE INVENTION AND RELATED ART STATEMENT

1. Field of the Invention

The present invention relates to a circuit breaker, and more particularly to a circuit breaker having an electromagnetic tripping device, a thermal tripping device and an adjusting device for the electromagnetic tripping device.

2. Description of the Related Art

FIGS. 6–10 show a conventional circuit breaker which was disclosed in the Japanese patent application No. SHO 52-138267. FIG. 6 shows a partly diagrammatic sectional view of the circuit breaker. In the figure, an operation handle 1 is provided in order to open/close contacts of the circuit breaker, cases 2 and 3 are made of insulating material, and a tripping device 5 for detecting an excessive overcurrent flowing through a conductor 4 is provided in the circuit breaker. FIG. 7 shows detailed view of the tripping device 5 for a three phase circuit breaker, and FIG. 8 shows a sectional view taken on line CC of FIG. 8. As shown in these figures, a trip-base 6 is made of an insulating material. Each phase conductors 4*a*, 4*b* and 4*c* are disposed in the circuit breaker through U-shaped fixed iron cores 7*a*, 7*b* and 7*c*, respectively. Movable iron cores 8*a*, 8*b* and 8*c* are held rotatably in anticlockwise direction being energized by coil springs 9*a*, 9*b* and 9*c*, respectively. The above-mentioned conductors 4*a*, 4*b* and 4*c*, the movable iron cores 8*a*, 8*b* and 8*c* and the fixed iron cores 7a, 7b and 7c form electromagnets, respectively. FIG. 10 shows a diagrammatic rear view of essential part of FIG. 7. In FIGS. 7 and 10, brackets 10*a*, 10*b* and 10*c* having bent end tip 10*d*, 10*e* and 10*f* are fixed to the fixes iron cores 7*a*, 7*b* and 7*c* by rivets 11*a*, 11*b* and 11*c*, respectively. As shown in FIG. 7, a trip lever 12 is held rotatably by the trip-base 6, and has pair of facing projections 12*a*, 12*b* and 12*c* at one side thereof. Upper ends of operation rods 13*a*, 13*b* and 13*c* are fixed to the movable iron cores 8*a*, 8*b* and 8*c*, and other movable ends thereof pass between the pair of facing projections 12*a*, 12*b* and 12*c*, respectively. End pieces 14*a*, 14*b* and 14*c* are provided to these movable ends of the operation rods 13*a*, 13*b* and 13*c*, respectively. As shown in FIGS. 7 and 8, a latch lever 15 which is fixed to the other side of the trip lever 12 engages a latch plate 16. As shown in FIG. 10, a link lever 17 which is made of hard insulating material has long holes 17*a*, 17*b* and 17*c*. The bent end tips 10*d*, 10*e* and 10*f* are inserted into the long holes 17*a*, 17*b* and 17*c* so as to hold the link lever 17, respectively. Arms 19*a*, 19*b* and 19*c* which have long holes 20*a*, 20*b* and 20*c* at upper ends thereof are held rotatably on the bracket 10*a*, 10*b* and 10*c* around holding pins 21*a*, 21*b* and 21*c*, respectively. Supporting rods 22*a*, 22*b* and 22*c* which are erected on the link lever 17 are engaged with the long hole 20*a*, 20*b* and 20*c*, respectively. Ends of screws 23*a*, 23*b* and 23*c* which are screwed into screw holes of the arm 19*a*, 19*b* and 19*c* contact with movable sides of the movable iron cores 8*a*, 8*b* and 8*c*, respectively, as shown in FIG. 7. Adjusting dial 24 which protrudes out of the trip base 6 is linked with a cam 26 being faced to one end of the center phase arm 19*b* by a cam shaft 25. As shown in FIG. 8, both an upper iron core 27 having a coil heater 29 wound thereon and a lower iron core 28 from a transformer in respective phases. A bimetal 30 is connected to the heater 29 so as to conduct heat therefrom, thereby to detect overcurrent. As shown in FIGS. 7 and 8, bimetals 31*a* and 31*b* for compensating ambient temperature change are disposed at the center of adjacent phases each other and are fixed to the lower part of the tripping lever 12 by screws 32*a* and 32*b* at lower ends thereof, respectively. Insulating bar 33 having three adjusting screws 35*a*, 35*b* and 35*c* is secured to other ends of the bimetals 31*a* and 31*b* by screws 34*a* and 34*b*. Spacer 36 is disposed on each phase between the lower iron core 28 and the fixed iron core, for example 7*b*, as shown in FIG. 8. As shown in FIG. 9, Leaf-spring 37 which is fixed on the trip base 6 by a screw 38 for making snap action, holds the adjusting dial 24 attached to one end of the cam shaft 25, rotatably. A cum supporting plate 39 which is fixed on the trip base 6 by a rivet 11*b* holds lower end of the cum shaft 25 rotatably.

In the above-mentioned circuit breaker, when a relatively small overcurrent flows through the circuit breaker, the bimetal 30 is bent to rightward of FIG. 8 by means of generation of heat in the coil heater 29. And thereby the adjusting screws 35*a*, 35*b* and 35*c* are pushed, so that the tripping lever 12 is rotated clockwise of FIG. 8. Then, the latch lever 15 is disengaged with the latch plate 16, thereby to open contacts(not shown) of the circuit breaker. When large overcurrent flows through the circuit breaker, the movable iron cores 8*a*, 8*b* and 8*c* are attracted to the fixed iron cores 7*a*, 7*b* and 7*c*, respectively. Thereby, when the operation rod, for example 13*c*, is lowered, the end piece 14*c* catches the pair of projections 12*c*, so that the tripping lever 12 is rotated clockwise of FIG. 8, thereby to open the contacts.

Next, adjusting procedure will be specified. In FIGS. 9, 10 and 11, when the adjusting dial 24 is rotated, the cam 26 is rotated coaxially, and thereby the arm 19*b* is rotated around the holding pin 21*b* and the screw 23*b* pushes/releases the movable iron core 8*b*, thereby to adjust a gap between the fixed iron core 7*b* and the movable iron core 8*b*. When the arm 19*b* is rotated, the supporting rod 22*b* which is caught by the long hole 20*b* is driven, and thereby the link lever 17 moves on a straight line in right or left directions as it is supported by the bent end tips 10*d*, 10*e* and 10*f* as shown in FIG. 10. Therefore, both arms 19*a* and 19*c* are rotated by the supporting rods 22*a* and 22*c*, respectively, and thereby the gaps between the fixed iron cores 7*a* and 7*c* and the movable iron cores 8*a* and 8*c* are adjusted.

In the above-mentioned conventional circuit breaker, as shown in FIGS. 7 and 8, the adjusting device for electromagnetic tripping comprising, for instance, the adjusting dial 24 and the cam 26, and the thermal tripping device comprising, for instance, bimetal 30 and coil heater 29, are disposed side by side in line(power source side of the circuit breaker)-load(load side of the circuit breaker) direction(left-right direction of FIG. 8), and thereby the circuit breaker has such problem that length thereof inevitably becomes long in the line-load direction. Furthermore, as shown in FIG. 7, engaging errors between the holding pin 21*b* and a hole engaged thereto(not shown), and a tilted cam 26 cause such state that the arm 19*b* is loose-assembled and has deformation by stresses thereof. Therefore, when the gap between the movable iron core 8*b* and the fixed iron core 7*b* is adjusted by rotating the adjusting dial 24, such problem occurs that the loose-assembly and the deformation of the arm 19*b* makes it difficult to adjust the gap correctly for a initial setting value.

OBJECT AND SUMMARY OF THE INVENTION

The object of the present invention is to provide a circuit breaker length of which is shortened in the line-load direction and which enables correct setting for the initial setting value.

In order to achieve the above-mentioned object, the circuit breaker in accordance with the present invention comprises:

a fixed conductor having a fixed contact, a movable conductor having a movable contact, electromagnetic tripping means for opening the movable contact from the fixed contact , thermal tripping means for opening the movable contact from the fixed contact, which is disposed side by side with the electromagnetic tripping means in power source side-load side direction, and adjusting means for the electromagnetic tripping means, which comprises a cam to be rotated by an adjusting dial, and an arm being pushed by the cam for moving a movable iron core of the electromagnetic tripping means at one end thereof, wherein improvement is that the adjusting means is disposed in perpendicular direction to the power source side-load side direction, above the thermal tripping means, and a fulcrum pin for rotating the arm is held movably for adjustment.

The above-mentioned circuit breaker has the following technical advantages.

Length of the circuit breaker in power source side-load side direction becomes shorter than that of the conventional circuit breaker.

Gap adjustment between the movable iron core and a fixed iron core of the electromagnetic tripping means for initial setting can be made correctly.

DESCRIPTION OF THE PREFERRED EMBODIMENT

Figure 1:
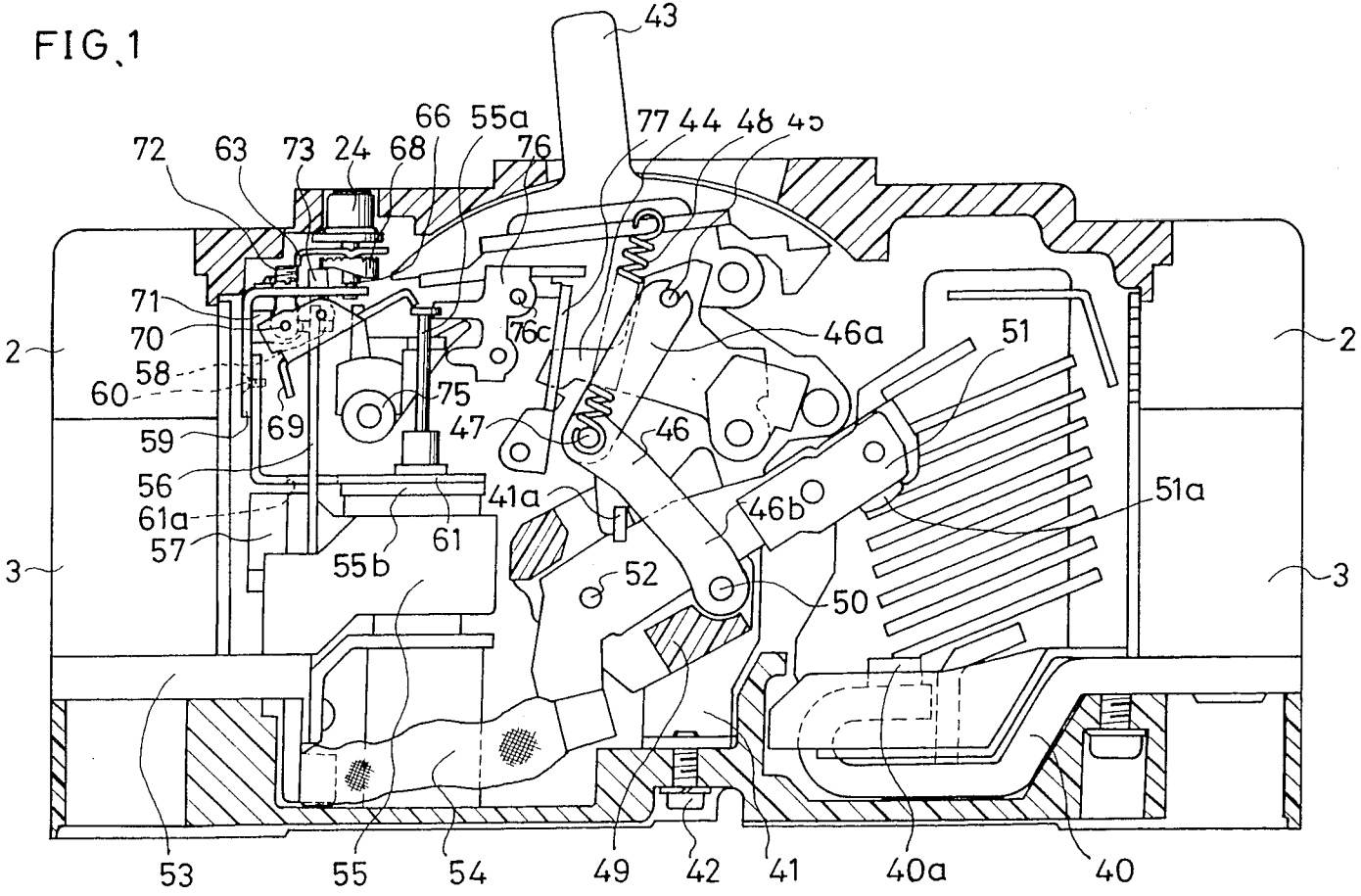
FIG. 1 is a sectional view showing an embodiment of a circuit breaker in accordance with the present invention.
Figure 2:
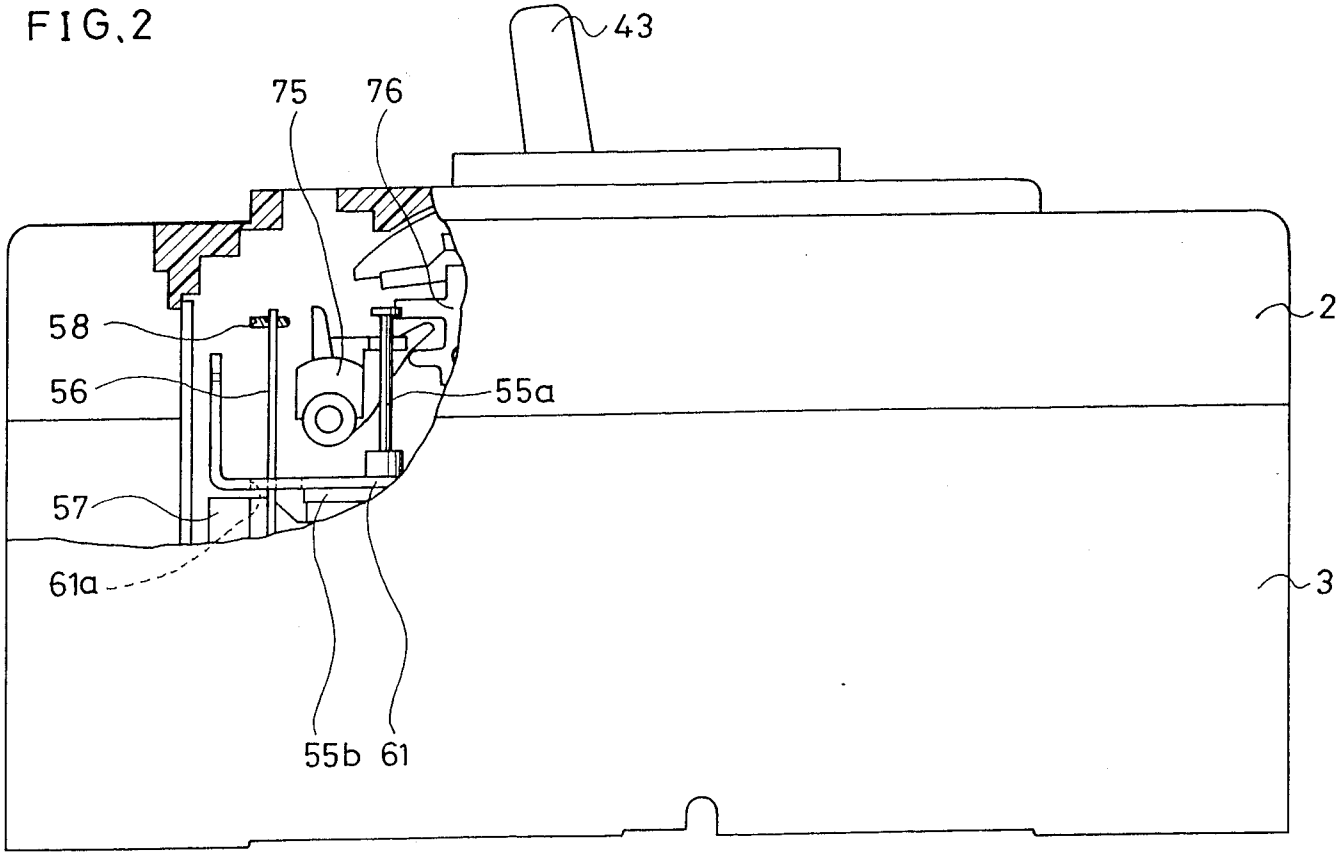
FIG. 2 is a partially sectional view showing an embodiment of a circuit breaker in accordance with the present invention.
Figure 3:
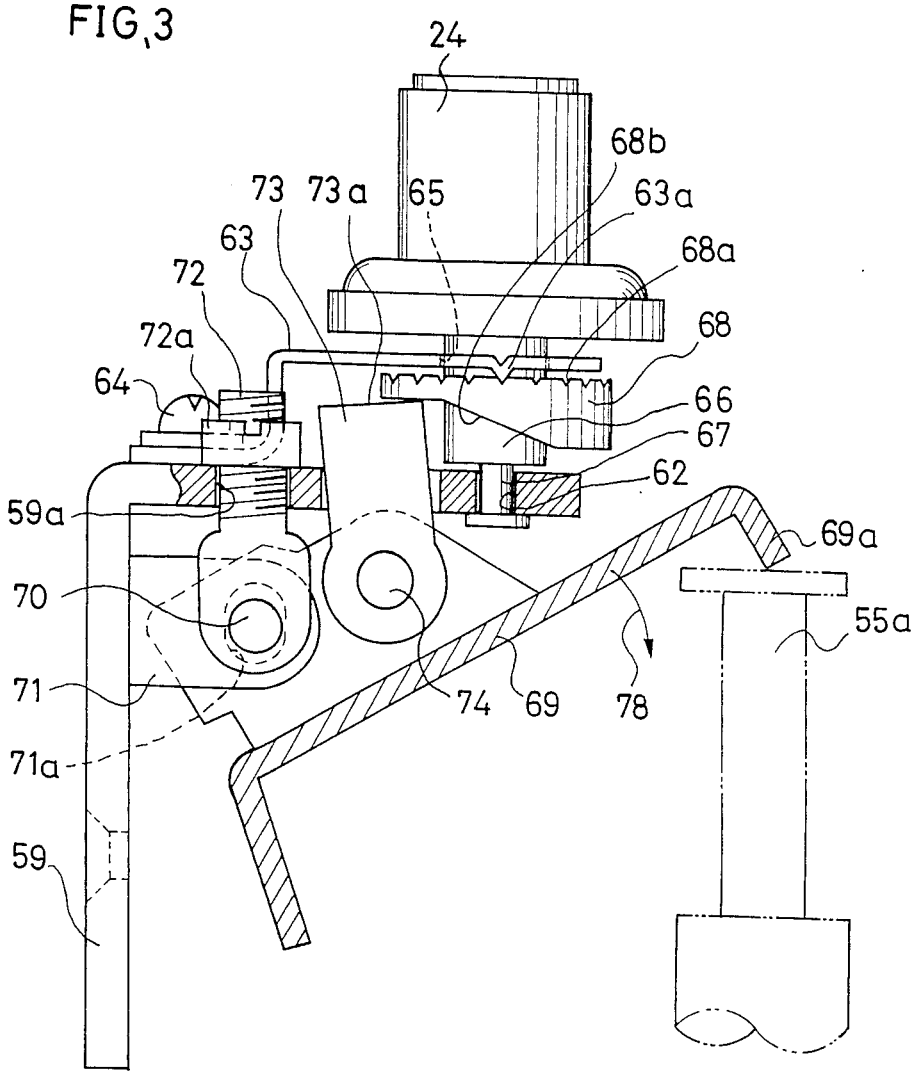
FIG. 3 is an enlarged side view showing after removal of an adjusting device for electromagnetic tripping of an embodiment of a circuit breaker in accordance with the present invention.

Hereafter, preferred embodiment of the present invention is described with reference to the accompanying drawings. FIG. 1 is a sectional view of a circuit breaker, and FIG. 3 is an enlarged side view of an adjusting device for electromagnetic tripping of FIG. 1. In FIG. 1, cases 2 and 3 are made of insulating material. Fixed conductors 40 which are fixed on the base 3 have fixed contacts 40*a* on its folded end part. A frame 41 is secured on the base 3 by screws 42. An operation handle 43 rotates around a projection 41*a* of the frame 41. A cradle 44 is held cradlably to the operation handle 43. An upper link pin 45 is provided on the operation handle 43. A link 46 comprises an upper link 46*a* and an lower link 46*b* being connected with each other by a link pin 47. A tension coil spring 48 pulls the link pin 47 to the operation handle 43, and thereby the upper link 46*a* is engaged with the upper link pin 45. A crossbar 49 connecting with the lower link 46*b* by the lower link pin 50, is held rotatably to the base 3. A movable conductor 51 having movable contact 51*a* is held rotatably to the crossbar 49 around a movable conductor pin 52. Fixed conductor 53 is fixed on the base 3, and a flexible conductor 54 connects the fixed conductor 53 with the movable conductor 51. An electromagnetic tripping device 55 having a movable iron core 55*a* for each phase is mounted on the base 3. A bimetal 56 which constitutes a thermal tripping device together with a heater 57 is provided aside the electromagentic tripping device 55. An adjusting screw 58 is screwed into an upper end of the bimetal 56 of FIG. 2, which shows a partially sectional view after removal a unit of adjusting device for electromagnetic tripping. In FIG. 1, a unit holding plate 61 is fixed on a yoke 55*b* of the electromagnetic tripping device 55 and has L-shaped configuration. A cam holding base 59 is fixed to the unit holding plate 61 by a screw 60. The unit holding plate 61 has a hole 61*a* for passing the bimetal 56 therein. As shown in FIG. 3, the cam holding base 59 has a hole 62 having two diameters (not shown) for inserting and catching an lower end of a cam shaft 66, respectively. One end of a leaf spring 63 which is fixed on the cam holding base 59 by a screw 64 and has a hole 65 therein, has a projection 63*a* for making snap action. Both sides of the cam shaft 66 are held rotatably by the hole 62 and 65, respectively. The cam shaft 66 has a flat headed slender spindle member 67 for engaging the hole 62. A cam 68 having notches 68*a* for making snap action is mounted on the cam shaft 66. An adjusting dial 24 is mounted on the upper end of the cam shaft 66. An arm 69 is engaged with a fulcrum pin 70, and an end of a contacting member 69*a* contacts a movable iron core 55*a*. An arm supporting member 71 having a long hole which extends in up-down directions and has the fulcrum pin 70 inserted movably therein, is projected on the cam holding base 59. An arm adjusting screw 72 is inserted. movably in up-down directions, and it holds the fulcrum pin 70 at a lower end thereof and is held on the cam holding base 59 by screwing nut 72*a* on an upper end thereof. An upper end of an up-down lever 73, which is held rotatably at the center of the arm 69 by a pin 74, slidingly contacts with a cam surface 68*b* of the cam 68. As shown in FIG. 1 or FIG. 2, a trip bar 75 engages with the movable iron core 55*a* and the adjusting screw 58. A latch 76 engages with the trip bar 75. a latch lever 77 (FIG. 1) engages with the latch 76 and the cradle 44(FIG. 1). The adjusting device for electromagnetic tripping are constructed for each phase of the circuit breaker by the parts numbered from 59 to 74 of FIG. 1 and FIG. 3.

Next, operation of the above-mentioned embodiment of circuit breaker will be described. As shown in FIG. 1, when the circuit breaker is closed (not shown in the figure) by putting down the movable contact 51*a* on the fixed contact 40*a*, current flows from the fixed conductor 40, via the fixed contact 40a, the movable contact 51*a* and the movable conductor 54, to the fixed conductor 53. When the circuit breaker is open as shown in FIG. 1, the link 46 is pulled into folded state by the pull spring 48. And the movable conductor 51 is raised together with the crossbar 49, thereby to open the movable contact 51*a*. When overcurrent flows through the closed circuit breaker, the bimetal 56 is bent, and thereby the trip bar 75 is rotated. When a very large overcurrent flows through the circuit breaker, the movable iron core 55*a* is attracted toward the electromagnetic tripping device 55, and thereby the trip bar 75 is rotated clockwise. When the trip bar 75 is rotated, the latch 76 is rotated anticlockwise around a pin 76*c* and the latch lever 77 is also rotated anticlockwise, and thereby the cradle 44 disengages with the latch lever 77 and jumps up. As a result, the link 46 is folded, and thereby the movable conductor 51 and the crossbar 49 are raised together, hence to trip the circuit braker.

As shown in FIG. 3, the arm 69 is positioned by suspending the fulcrum pin 70 by means of the arm adjusting screw 72. And the contacting member 69*a* contacts with the movable iron core 55*a* in a state of being locked in upward rotation by the up-down lever 73. Under the above-mentioned state, a gap between the movable iron core 55*a* and a fixed iron core (not shown) of the electromagnetic tripping device 55 is set for initial setting value. After that, when the arm adjusting screw 72 is raised/lowered by rotating the nut 72*a*, the fulcrum pin 70 moves up/down along the long hole 71*a* together with the arm adjusting screw 72 while the upper end 73*a* contacts the cam surface 68b of the cum 68. Thereby, the arm 69 rotates around the pin 74 of the up-down lever 73, and thereby the contacting member 69*a* raises/lowers the movable iron core 55*a*. Therefore, transmission errors from the pin 74 to the movable iron core 55*a* to be caused by loose-assembly and deformation of the arm 69 are compensated by adjusting the arm adjusting screw 72 so as to push the movable iron core 55*a* further.

The electromagnetic tripping device 55 (FIG. 1) is adjustable by rotating the adjusting dial 24. As shown in FIG. 3, when the adjusting dial 24 is rotated, the cam 68 rotates in the same way, and thereby the up-down lever 73 moves downward and the arm 69 rotates in the direction shown by arrow 78 around the fulcrum pin 70. Therefore, the gap (not shown) between the lower end of the movable iron core 55*a* and the fixed iron core (not shown) of the electromagnetic tripping device 55 is adjusted to a predetermined value. Then, the loose-assembly between the fulcrum pin 70 and its inserting hole, the loose-assembly between the cam 68 and the up-down lever 73, and the deformation of the arm 69 have been already compensated by adjusting the arm adjusting screw 72 after the assembly of the arm 69. Therefore, the gap (not shown) between the movable iron core 55*a* and the fixed iron core (not shown) of the electromagnetic tripping device 55 can be adjusted correctly to an initial predetermined value.

As for the thermal tripping device shown in FIG. 1 or FIG. 2, it is not easy to adjust the adjusting screw 58 provided on upper end of the bimetal 56, since the adjusting screw 58 is covered by the adjusting device for the electromagnetic tripping. However, after removal of the cam holding base 59 with all adjusting device for the electromagnetic tripping from the unit holding plate 61 by removing the screw 60, the adjusting screw 58 becomes easily adjustable as shown in FIG. 2. Disposing the adjusting device for the electromagnetic tripping above the bimetal 56 of the thermal tripping device in perpendicular direction to the line-load direction makes the length of the circuit breaker in the line-load direction shorter than that of the conventional circuit breaker.

Figure 4:
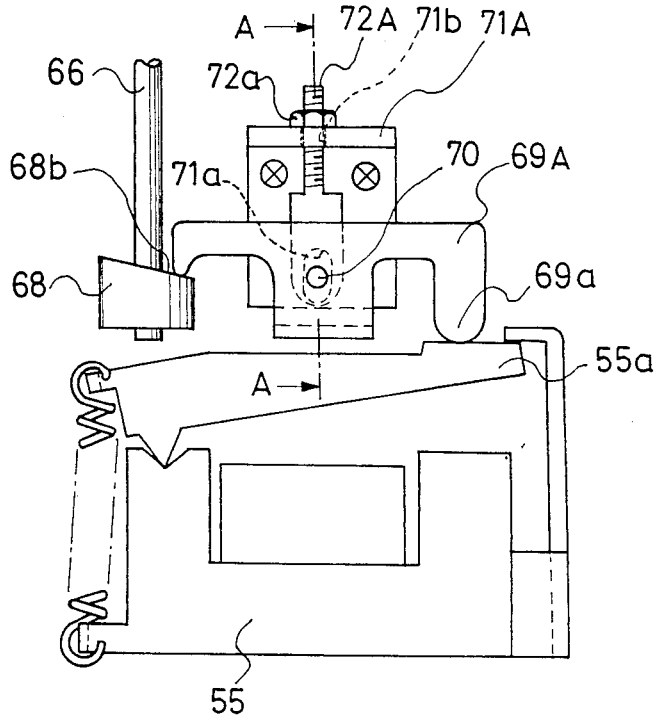
FIG. 4 is a side view showing an adjusting device for electromagnetic tripping of another embodiment of a circuit breaker in accordance with the present invention.
Figure 5:
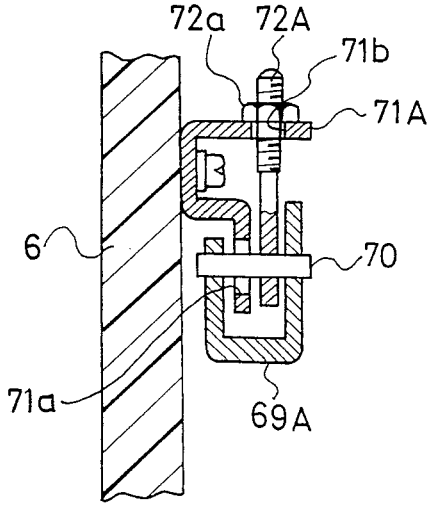
FIG. 5 is a partially by sectional view taken on line A—A of FIG. 4.
Figure 6:
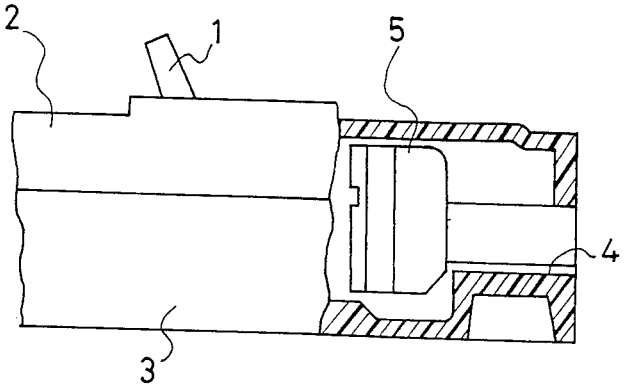
FIG. 6 (Prior Art)
FIG. 6 is the partially sectional view of the conventional circuit breaker.
Figure 7:
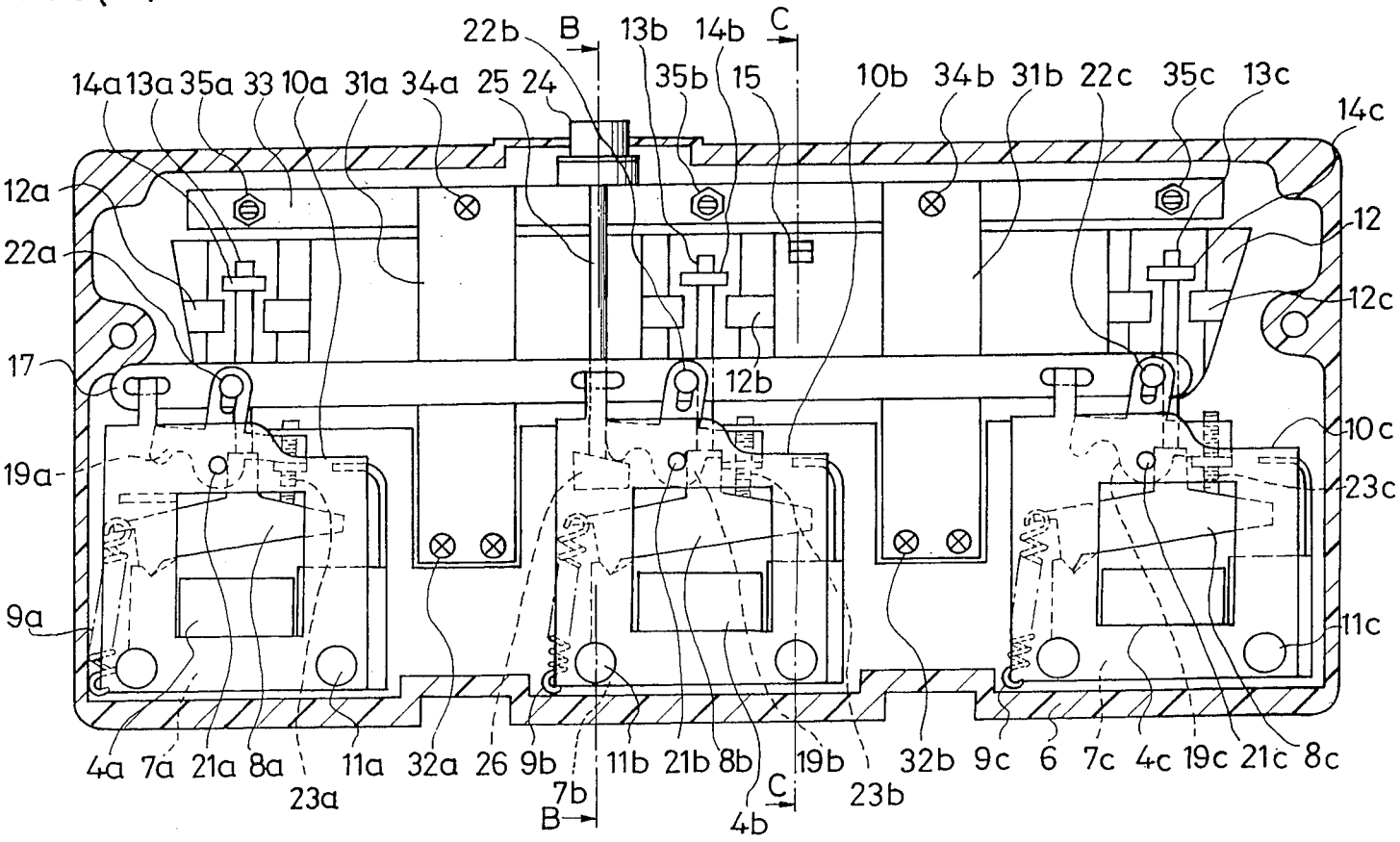
FIG. 7 (Prior Art)
FIG. 7 is the detailed view of the tripping device in the conventional circuit breaker.
Figure 8:
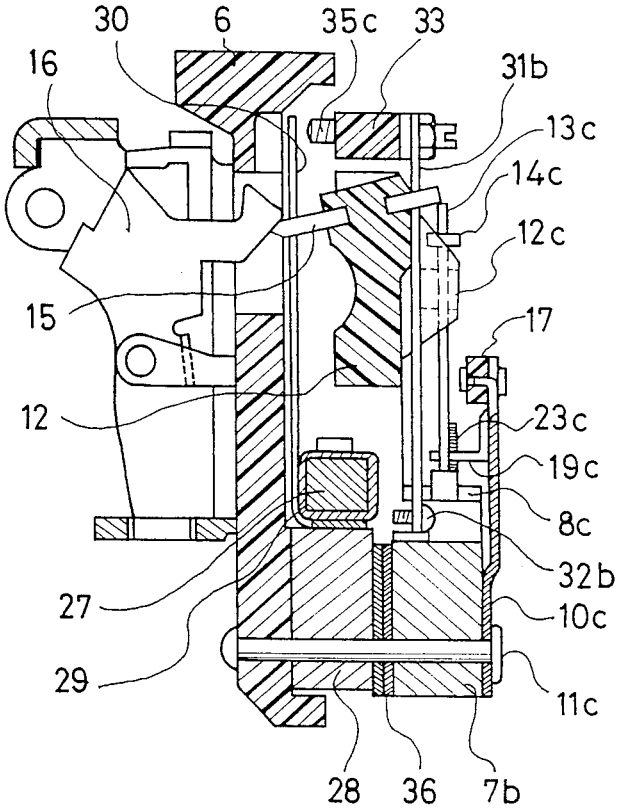
FIG. 8 (Prior Art)
FIG. 8 is the sectional view taken on line C—C of FIG. 7.
Figure 9:
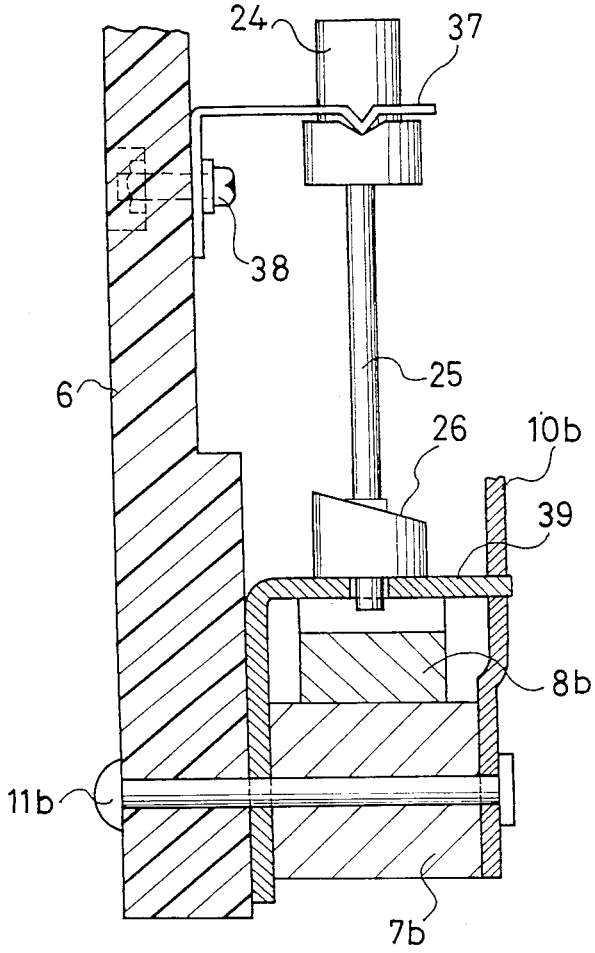
FIG. 9 (Prior Art)
FIG. 9 is the partially sectional view taken on line B—B of FIG. 7.
Figure 10:
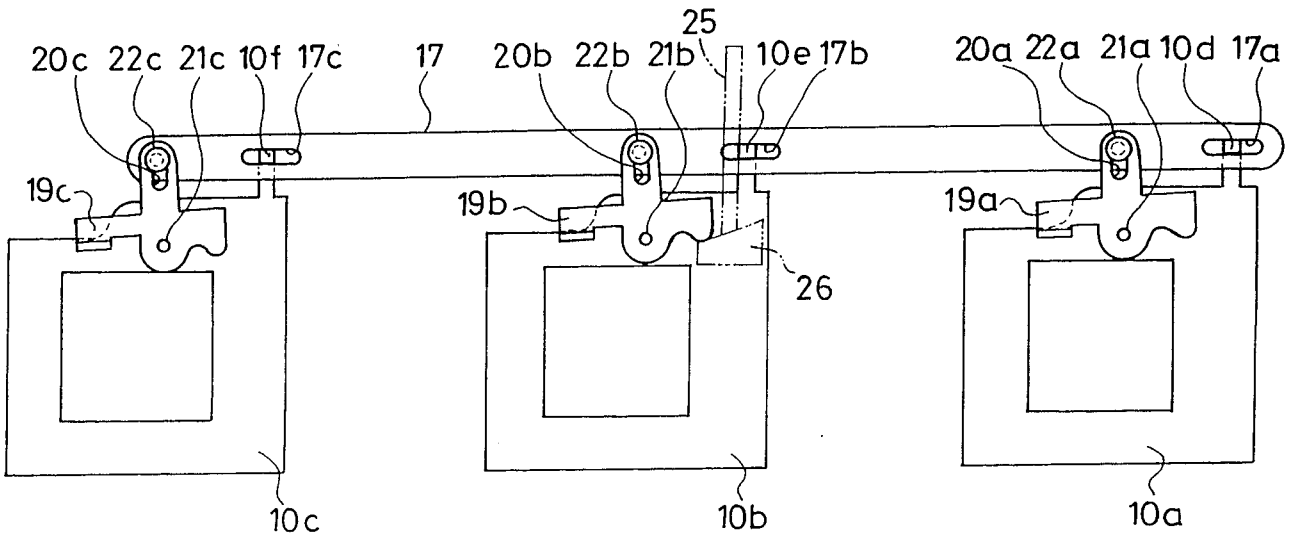
FIG. 10 (Prior Art)
FIG. 10 is the diagrammatic rear view of essential part of FIG. 7.
Figure 11:
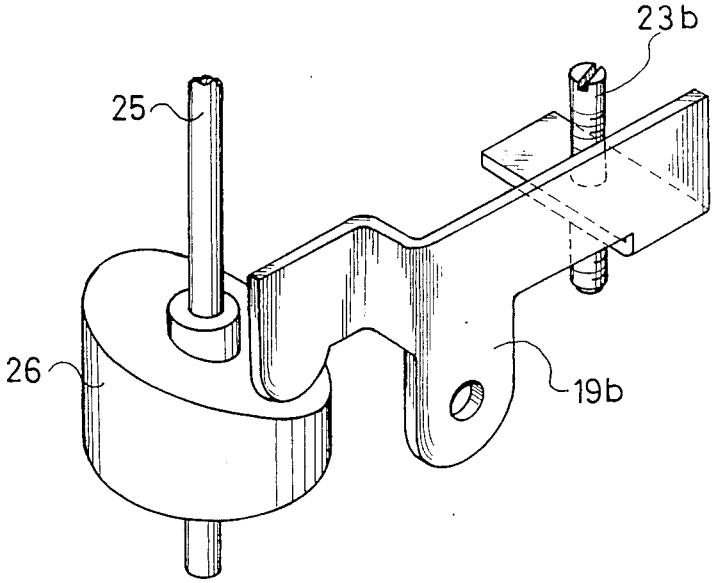
FIG. 11 (Prior Art)
FIG. 11 is the perspective view of the arm of the conventional circuit breaker.

Next, another embodiment of the present invention is described with reference to FIGS. 4 and 5. FIG. 4 is a side view showing an adjusting device for electromagnetic tripping, and FIG. 5 is a partially sectional view taken on line A—A of FIG. 4. Corresponding parts to the aforementioned first embodiment are designated by the same numbers, and duplicate descriptions therefor are omitted. In these figures, an arm 69A is held cradlably by a fulcrum pin 70 at center part thereof. One end of the arm 69A contacts a cam surface 68*b* of a cum 68 and another end thereof has a contacting member 69*a* which contacts a movable iron core 55*a*. An arm holder 71A having a long hole 71*a* which extends in up-down directions in order to insert the fulcrum pin 70 movably in that directions is fixed on a trip base 6. An arm adjusting screw 72A which is inserted into a hole 71*b* of the arm holder 71A adjustably holds the fulcrum pin 70 by its hole formed at a lower end part thereof, and upper end thereof is held on the arm holding member 71A by a nut 72*a*. Since an operation of this adjusting device is similar to that of first embodiment, descriptions of operation are omitted.

While specific embodiments of the invention have been illustrated and described herein, it is realized that other modifications and changes will occur to those skilled in the art. It is therefore to be understood that the appended claims are intended to cover all modifications and changes as fall within the true spirit and scope of the invention.

What is claimed is:

1. A circuit breaker having a housing comprising:

a first conductor having a fixed contact fixedly mounted in said housing, a second conductor having a movable contact movably mounted in said housing for movement in a first direction into and out of engagement with said fixed contact, said first direction being generally perpendicular to a reference plane in which said fixed contact is disposed, electromagnetic tripping means having a movable iron core for moving said movable contact from engagement with said fixed contact, thermal tripping means for moving said movable contact from engagement with said fixed contact, said thermal tripping means being disposed side by side with said electromagnetic tripping means in relation to said reference plane, adjusting means for said electromagnetic tripping means comprising a cam mounted to be rotated about an axis by an adjusting dial, and arm means engaging said cam and said movable iron core for moving said movable iron core of said electromagnetic tripping means, the improvement comprising;

said adjusting means being disposed with said axis substantially perpendicular to said reference plane with said adjusting means disposed a greater distance from said reference plane than said thermal tripping means is disposed from said reference plane whereby said adjusting means is disposed above said thermal tripping means, and said arm means includes an arm mounted on a fulcrum pin for rotation thereabout, said fulcrum pin being mounted movably for adjustment.

2. A circuit breaker in accordance with claim 1, wherein said adjusting means comprises a unit removably mounted in said housing.

3. A circuit breaker in accordance with claim 2, wherein said adjusting means unit is mounted on a base which is fixed by screw to a yoke of said electromagnetic tripping means.

4. A circuit breaker in accordance with claim 1, wherein said cam is carried by a mounting base fixedly mounted in said housing, and said fulcrum pin of said arm is held in an elongated aperture in said mounting base, and including an adjusting screw which carries said fulcrum pin for movement in the direction of the long axis of said elongated aperture, said adjusting screw being adjustably engaged with said mounting base.

* * * * *